US007110743B2

(12) United States Patent
Depew et al.

(10) Patent No.: US 7,110,743 B2
(45) **Date of Patent: *Sep. 19, 2006**

(54) COMMUNICATIONS DEVICE FOR A PROTECTIVE HELMET

(75) Inventors: Larry Depew, Medina, OH (US); Joseph Birli, Munson, OH (US); Lou Monaco, South Euclid, OH (US); Greg Skillicom, Akron, OH (US); Dan Zimet, South Euclid, OH (US); Dave Potts, Parma Heights, OH (US); Michael T. Rupert, Sarver, PA (US); John L. Hierbaum, Murrysville, PA (US); Layton A. Wise, Washington, PA (US); F. Joseph Hersick, Zelienople, PA (US)

(73) Assignee: Mine Safety Appliances Company, Pittsburgh, PA (US)

( * ) Notice: Subject to any disclaimer, the term of this patent is extended or adjusted under 35 U.S.C. 154(b) by 372 days.

This patent is subject to a terminal disclaimer.

(21) Appl. No.: 10/609,829

(22) Filed: Jun. 30, 2003

(65) Prior Publication Data

US 2004/0261158 A1 Dec. 30, 2004

(51) Int. Cl.
*H04M 11/04* (2006.01)

(52) U.S. Cl. ..... 455/404.1; 455/90.2; 455/90.3; 455/550.1; 455/575.1; 455/575.2; 381/375; 381/376

(58) Field of Classification Search ..... 455/90.2, 455/90.3, 550.1, 575.1, 575.2, 404.1; 381/151, 381/370, 375, 376, 385
See application file for complete search history.

(56) References Cited

U.S. PATENT DOCUMENTS

| | | | | |
|---|---|---|---|---|
| 2,993,962 | A | 7/1961 | Hothem | |
| 3,495,272 | A | 2/1970 | Tempelhof | |
| 3,787,641 | A * | 1/1974 | Santori | 381/151 |
| 3,789,427 | A | 2/1974 | Aileo | 2/3 |
| 3,869,584 | A | 3/1975 | Wilde | 179/156 |
| 4,023,209 | A | 5/1977 | Frieder, Jr. et al. | 2/6 |
| 4,315,335 | A | 2/1982 | Kennedy, Jr. et al. | 2/424 |
| 4,422,185 | A * | 12/1983 | Cook | 2/8 |

(Continued)

FOREIGN PATENT DOCUMENTS

DE 90 03 237 5/1990

(Continued)

OTHER PUBLICATIONS

Product Development Agreement between Mine Safety Appliances Company and Audiopack Technologies, Inc. dated Apr. 9, 2002.

*Primary Examiner*—Steve M. D'Agosta
(74) *Attorney, Agent, or Firm*—James G. Uber; Richard L. Byrne

(57) ABSTRACT

A communications device for use with a protective helmet having a headband is provided. Generally, the communications device provides support member for a bone conduction microphone that is easily added to and removed from the protective helmet, allowing the communications device to be readily used with both new and existing protective helmets. While in use, support member positions the bone conduction microphone between the headband and a user's head, preferably between the napestrap and the center of the back of the user's head. The communications device can be used with any type of protective helmet, such as a fireman's helmet, a military helmet, a hard-hat, etc.

33 Claims, 8 Drawing Sheets

U.S. PATENT DOCUMENTS

| | | | | | |
|---|---|---|---|---|---|
| 4,520,238 | A | | 5/1985 | Ikeda | 179/121 |
| 4,942,628 | A | | 7/1990 | Freund | 2/416 |
| 5,054,079 | A | | 10/1991 | Frielingsdorf et al. | 381/151 |
| 5,078,130 | A | | 1/1992 | Van Oosten et al. | 128/201.24 |
| 5,151,944 | A | | 9/1992 | Yamamura | 381/151 |
| 5,163,093 | A | * | 11/1992 | Frielingsdorf et al. | 381/151 |
| 5,404,577 | A | | 4/1995 | Zuckerman et al. | 455/66 |
| 5,603,117 | A | * | 2/1997 | Hudner et al. | 2/6.6 |
| 5,619,754 | A | | 4/1997 | Thurwanger et al. | 2/418 |
| 5,678,205 | A | * | 10/1997 | Gray | 455/90.3 |
| 5,771,886 | A | | 6/1998 | Maire et al. | 128/207.11 |
| 5,790,681 | A | * | 8/1998 | Leppalahti | 381/385 |
| 5,793,878 | A | * | 8/1998 | Chang | 381/370 |
| 5,881,160 | A | * | 3/1999 | Sheppard | 381/376 |
| 5,915,538 | A | | 6/1999 | Basson et al. | 2/421 |
| 5,950,245 | A | | 9/1999 | Binduga | 2/417 |
| 5,970,155 | A | | 10/1999 | Leppalahti | 381/72 |
| 5,986,813 | A | | 11/1999 | Saikawa et al. | 359/630 |
| 6,104,816 | A | | 8/2000 | Downs, Jr. et al. | 381/94.1 |
| 6,178,251 | B1 | | 1/2001 | Luchs et al. | 381/364 |
| 6,272,227 | B1 | | 8/2001 | Yanagisawa | 381/104 |
| 6,298,249 | B1 | * | 10/2001 | Locarno et al. | 455/575.2 |
| 6,374,407 | B1 | | 4/2002 | Howell | 2/6.7 |
| D460,436 | S | | 7/2002 | Bjorklund et al. | D14/205 |
| 6,473,651 | B1 | | 10/2002 | Kuzma et al. | 607/57 |
| 6,496,589 | B1 | * | 12/2002 | Pham et al. | 381/375 |
| 6,792,122 | B1 | * | 9/2004 | Okada et al. | 381/151 |
| 2002/0077831 | A1 | | 6/2002 | Numa | 704/275 |
| 2002/0122563 | A1 | | 9/2002 | Schumaier | 381/326 |
| 2003/0083112 | A1 | | 5/2003 | Mikio | |

FOREIGN PATENT DOCUMENTS

| | | |
|---|---|---|
| EP | 0 519 621 | 12/1992 |
| EP | 0 618 751 | 10/1994 |

* cited by examiner

COMMUNICATIONS DEVICE FOR A PROTECTIVE HELMET

FIELD OF THE INVENTION

The present invention relates generally to a communication device for use with a protective helmet.

BACKGROUND OF THE INVENTION

Bone conduction microphones are known in the art and are used in communication systems for the transmission of speech. When a person speaks the cranial bones vibrate in accordance with the sounds that are produced by the person's vocal cords. Bone conduction microphones detect vibrations in the user's cranial bones and convert the vibrations to electrical signals that can be communicated to a two way radio. Bone conduction microphones are especially useful in noisy environments such as, for example, in helicopters, at fire sites, at construction sites, etc., where typical microphones may pick up and transmit a significant amount of ambient noise. Many of these environments require a user to where a protective helmet that has an adjustable headband.

Bone conduction microphones must firmly engage or abut the bone through which the vibrations are traveling for the bone conduction microphone to consistently and reliably detect the vibrations and convert the detected vibrations to electrical signals.

Attempts have been made to attach bone conduction microphones to protective helmets. See for example U.S. Pat. No. 6,298,249 (the '249 patent) in which a bone conduction microphone is mounted on the napestrap of the helmet. The napestrap is the portion of the headband that is generally located in the rear of the helmet and is positioned over the nape of the neck.

These devices, however, include multiple movable parts that must be correctly adjusted for the bone conduction microphone to function properly. For example, the assembly of the '249 patent includes a sliding mechanism that must be closed around a ratchet sleeve, carried on the helmet's napestrap. A ratchet sleeve is a sleeve carried by the napestrap portion of the headband. The ratchet sleeve has an adjustment knob that rotates to increase/decrease the size of the headband. In addition, a screw mechanism must be tightened to secure the assembly to the ratchet sleeve. Further, the microphone is on a separate adjustable flange and must be adjusted to fit the user's head, and a screw mechanism needs to be tightened to retain the microphone in its adjusted position.

Moreover, these devices do not place the microphone in an optimal position to consistently and reliably detect the vibrations in the cranial bones. Further the position of the microphone may need to be adjusted during use, which is impossible, or at least very inconvenient, in many circumstances, such as while fighting a fire, or in the middle of a rescue attempt. In addition, it is not easy and/or convenient to secure these devices to a helmet. Finally, these devices limit the placement of a speaker to one side of the helmet.

SUMMARY OF THE INVENTION

One embodiment of a communications device is provided which includes a support for positioning a bone conduction microphone between the headband of the helmet and the user's head. The support includes a support flange or projection for resting on the upper edge of the headband so that the headband can carry the weight of the device when the helmet is in position on the user's head. With this structure, the helmet's headband not only secures the helmet in place but also secures the microphone in direct engagement with the user's head and simultaneously supports the weight of the device. Therefore, the device can be easily mounted on and secured to the helmet's headband without using or adjusting various moveable parts.

Thus, an improved communications device for use with a protective helmet having a headband is provided. The device includes a bone conduction microphone, and a support for mounting the device on the headband, preferably on the napestrap portion of the headband, and for positioning the microphone between the headband and the user's head when the device is mounted in this way.

BRIEF DESCRIPTION OF THE DRAWINGS

FIG. 1 B is a prospective view of one embodiment of a protective helmet having an adjustable headband with a ratchet sleeve.

FIG. 1 C is a prospective view one embodiment of of a ratchet sleeve located on the napestrap portion of an adjustable headband having a ratchet sleeve.

DETAILED DESCRIPTION OF THE ILLUSTRATED EMBODIMENT

Figure 1A:
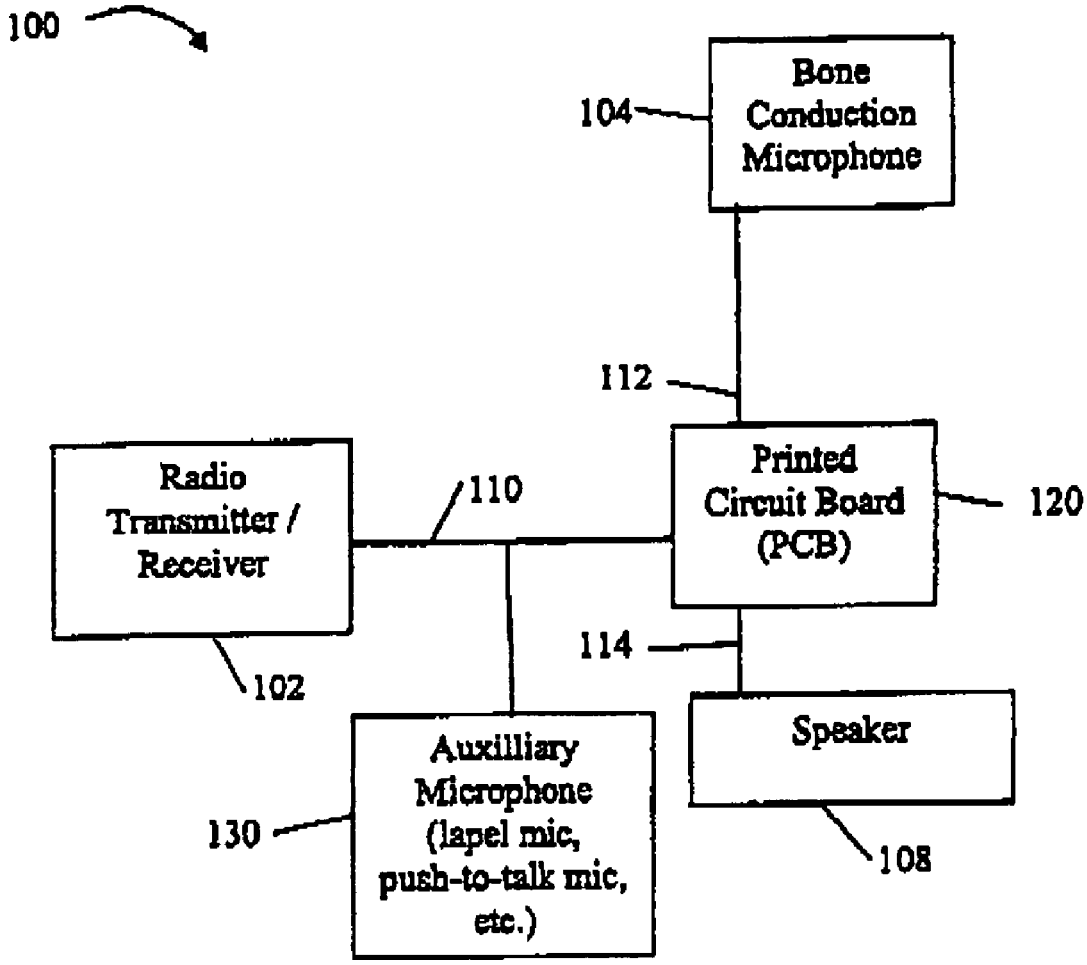
Fig. 1A PRIOR ART
FIG. 1 A is a block diagram of one embodiment of a bone conduction microphone, radio transmitter/receiver, a speaker and an optional auxiliary microphone.

One embodiment of the present invention relates generally to a communication device for use with a protective helmet and more specifically to embodiments of a support member configured to connect to a napestrap portion of a headband of a protective helmet. The support member is configured to place a bone conduction microphone between the napestrap of the protective helmet and a user's head. Illustrated in FIG. 1 is an embodiment of a communication system 100. The communication system 100 includes a radio transmitter/receiver 102 electrically coupled to a printed circuit board (PCB) 120 via cable 110. PCB 120 is electrically coupled to a bone conduction microphone 104 and a speaker assembly 108 via cables 112, 114 respectively. Thus, the bone conduction microphone 104 and speaker 108 are placed in circuit communication with the radio transmitter/receiver 102. In addition, an optional auxiliary microphone 130, such as a push-to-talk (PIT) microphone, a lapel microphone (LM) etc. is shown. As a result, PCB 120 can be placed directly in circuit communication with the radio transmitter/receiver, or placed in circuit communication with the radio transmitter/receiver 102 via the auxiliary microphone 130.

Vibrations in bones, such as cranial bones, are created when a user speaks. The bone conduction microphone 104 detects and amplifies the vibrations in the cranial bones. The bone conduction microphone 104 is made up of a vibration sensor (not shown) and electrical circuitry. The electrical circuitry can be located integral with the vibration sensor or remote from the vibration sensor, preferably the electrical circuitry is located on PCB 120, or in circuitry located in the optional auxiliary microphone. The vibrations are detected and converted into electrical signals that are representative of the user's voice. The electrical signals can be communicated to the radio transmitter/receiver via cable 112 and PCB 120 where the electrical signals can be transmitted to a second radio receiver (not shown). One embodiment of a bone conduction microphone is disclosed in U.S. Pat. No. 5,054,079, which is hereby incorporated by reference. Other bone conduction microphones can also be used.

Electrical signals received by the radio transmitter/receiver 102 can be communicated to the speaker assembly 108 via cable 110, PCB 120 and cable 114. The electrical signals communicated to the speaker assembly 108 cause a membrane (not shown) inside the speaker to vibrate. The vibrations in the membrane produce an aural transmission within the frequency range detectable by the user. Preferably, the aural transmissions are representative of a human voice.

Figure 1B:
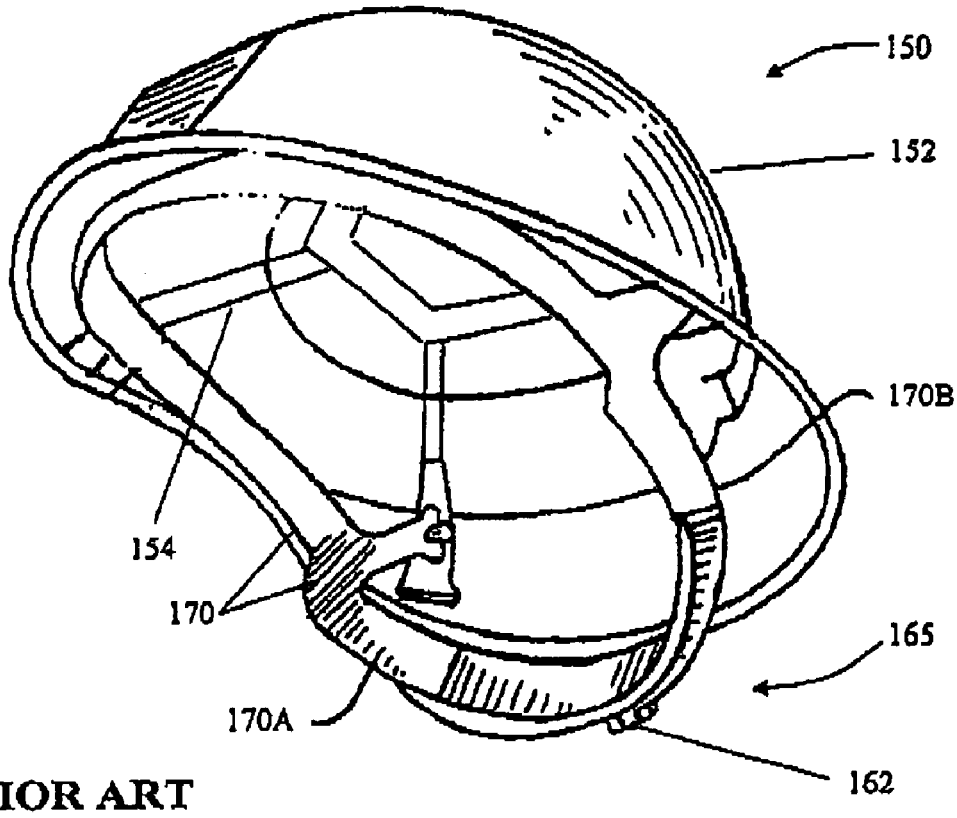
PRIOR ART Fig. 1B
Figure 1C:
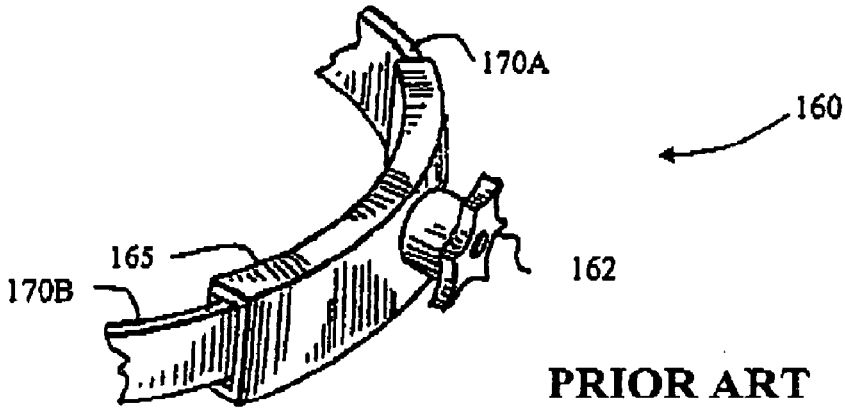
PRIOR ART Fig. 1C
Figure 2:
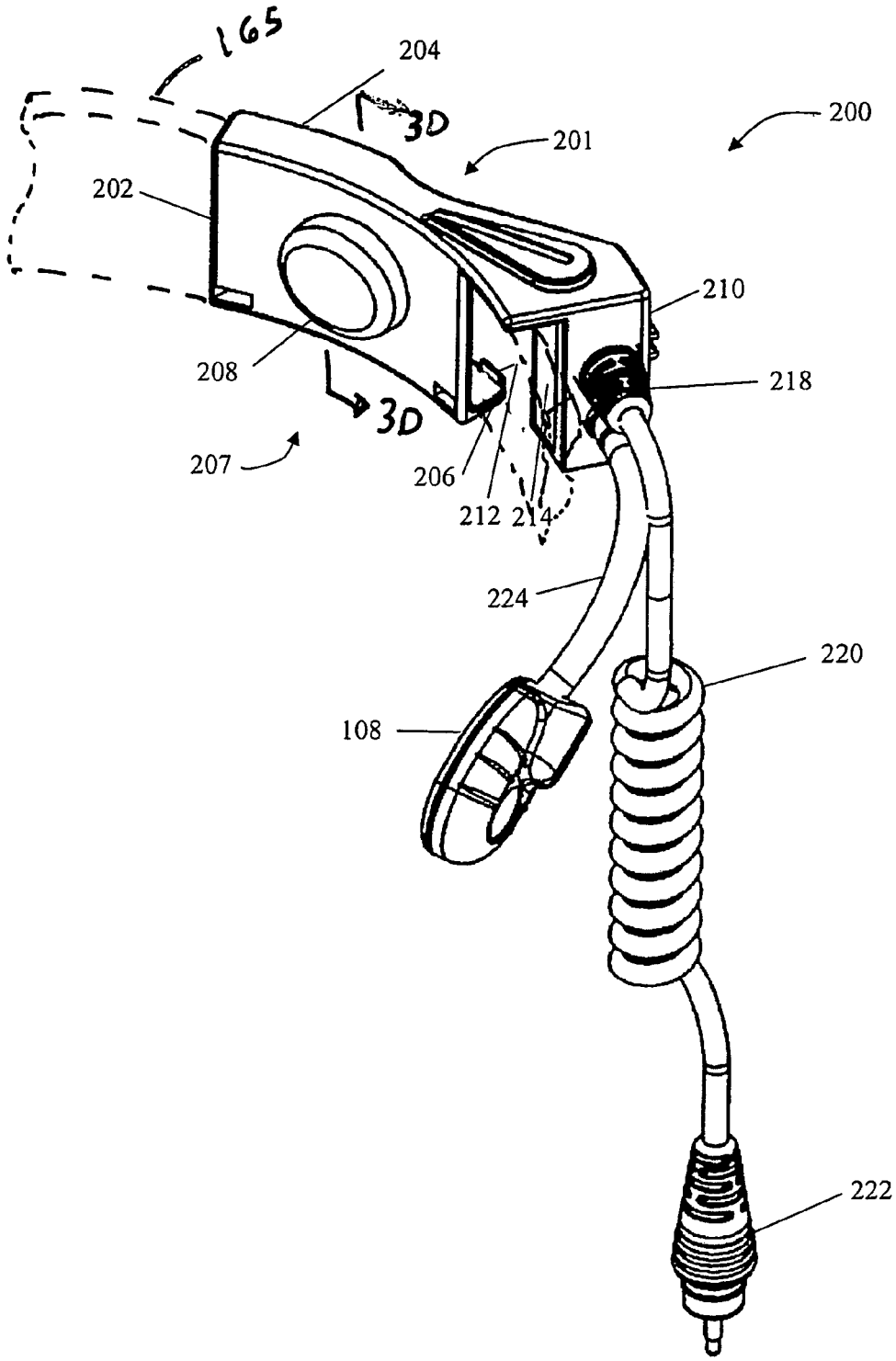
FIG. 2 is a prospective view of one embodiment of a communications device.
Figure 3A:
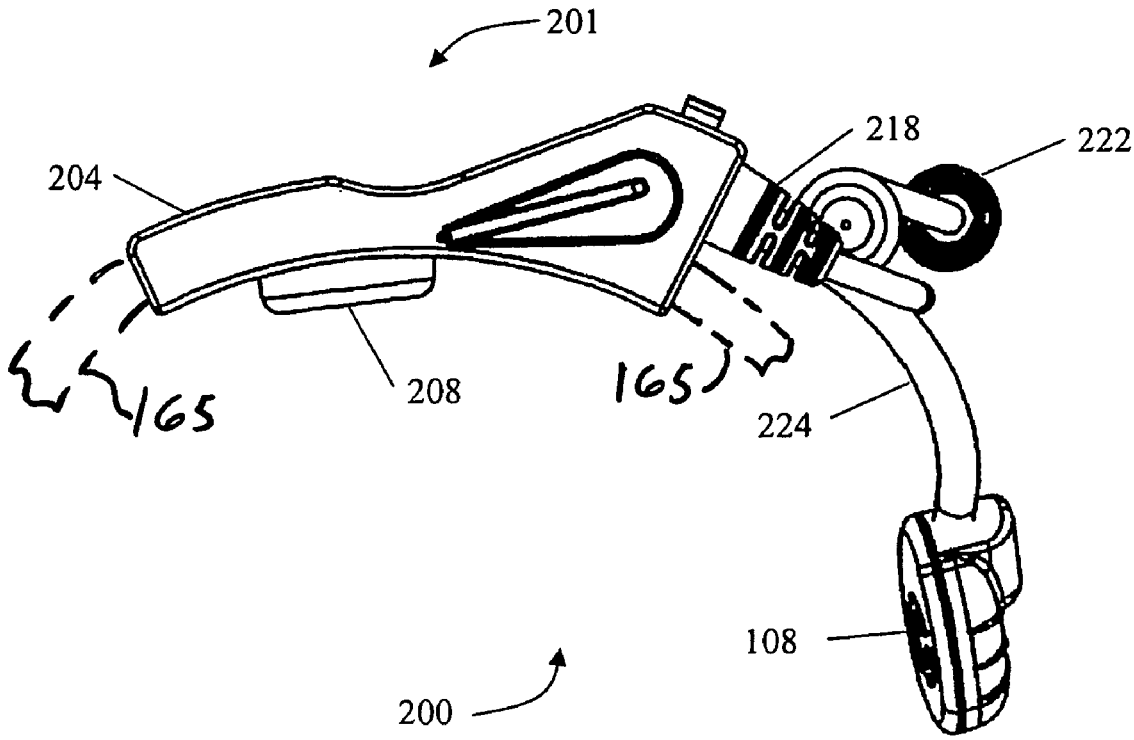
FIG. 3A is a plan view of the assembly illustrated in FIG. 2.
Figure 3B:
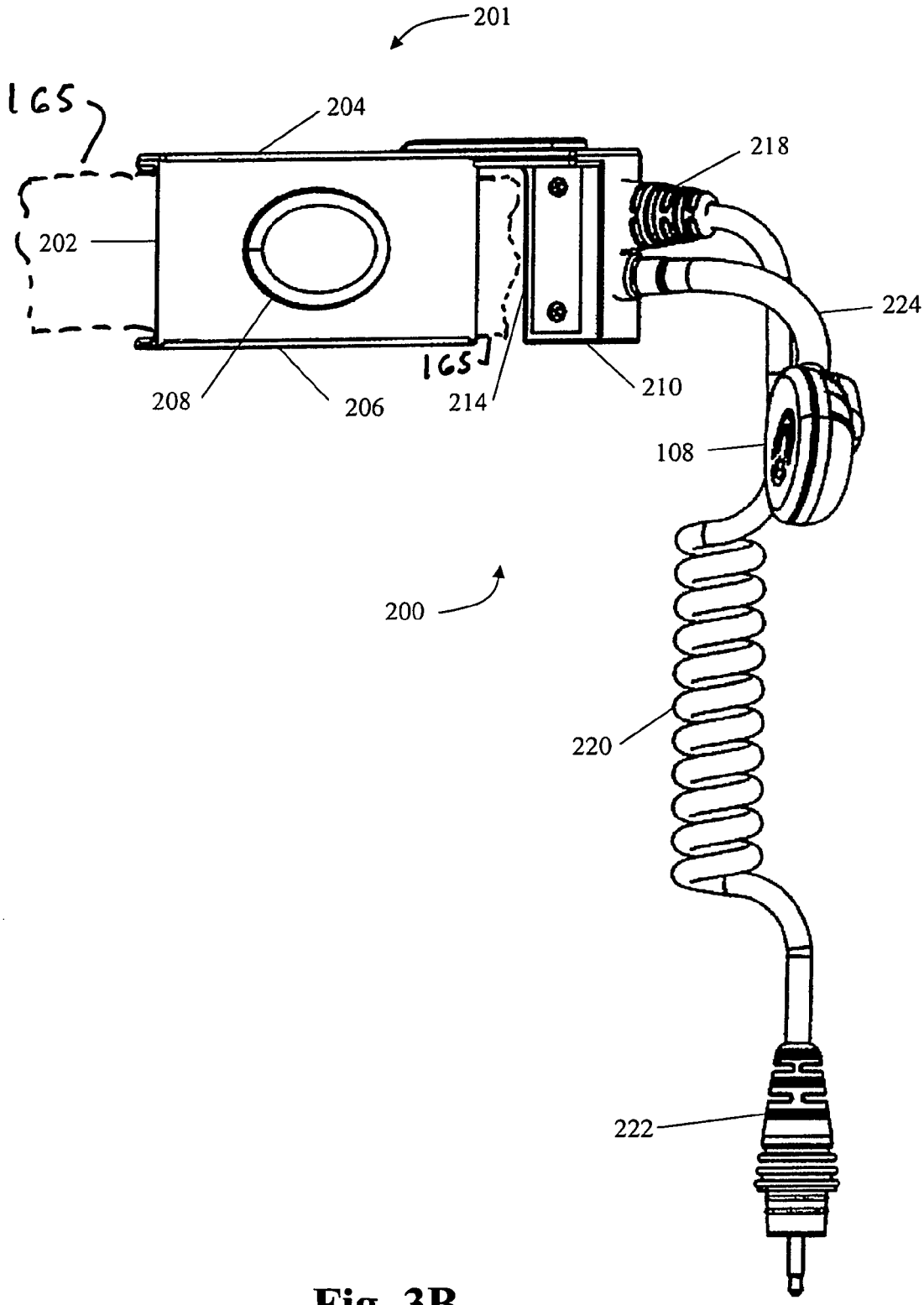
FIG. 3B is a front view of the assembly illustrated in FIG. 2.
Figure 3C:
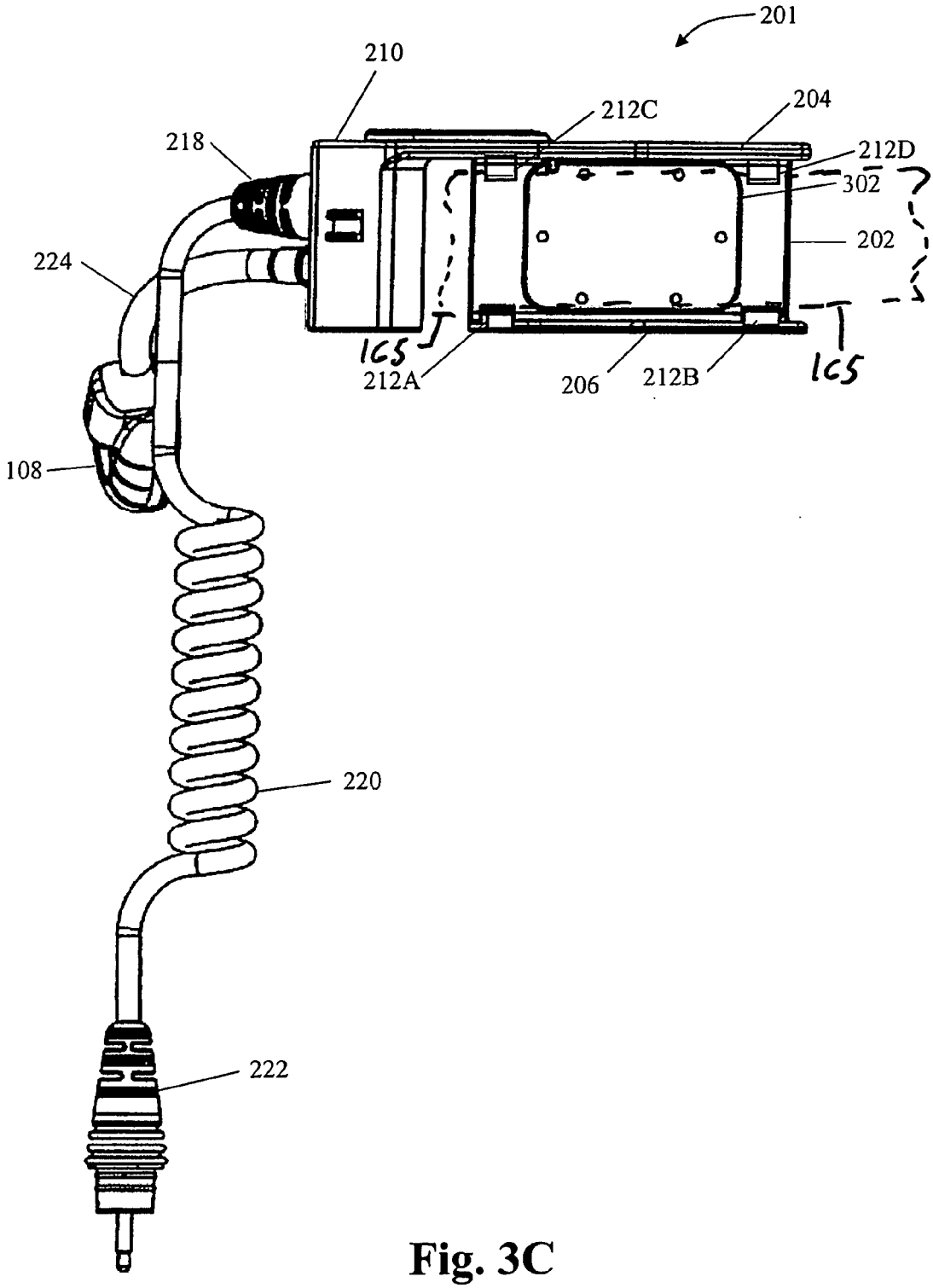
FIG. 3C is a rear view of the assembly illustrated in FIG. 2.
Figure 3D:
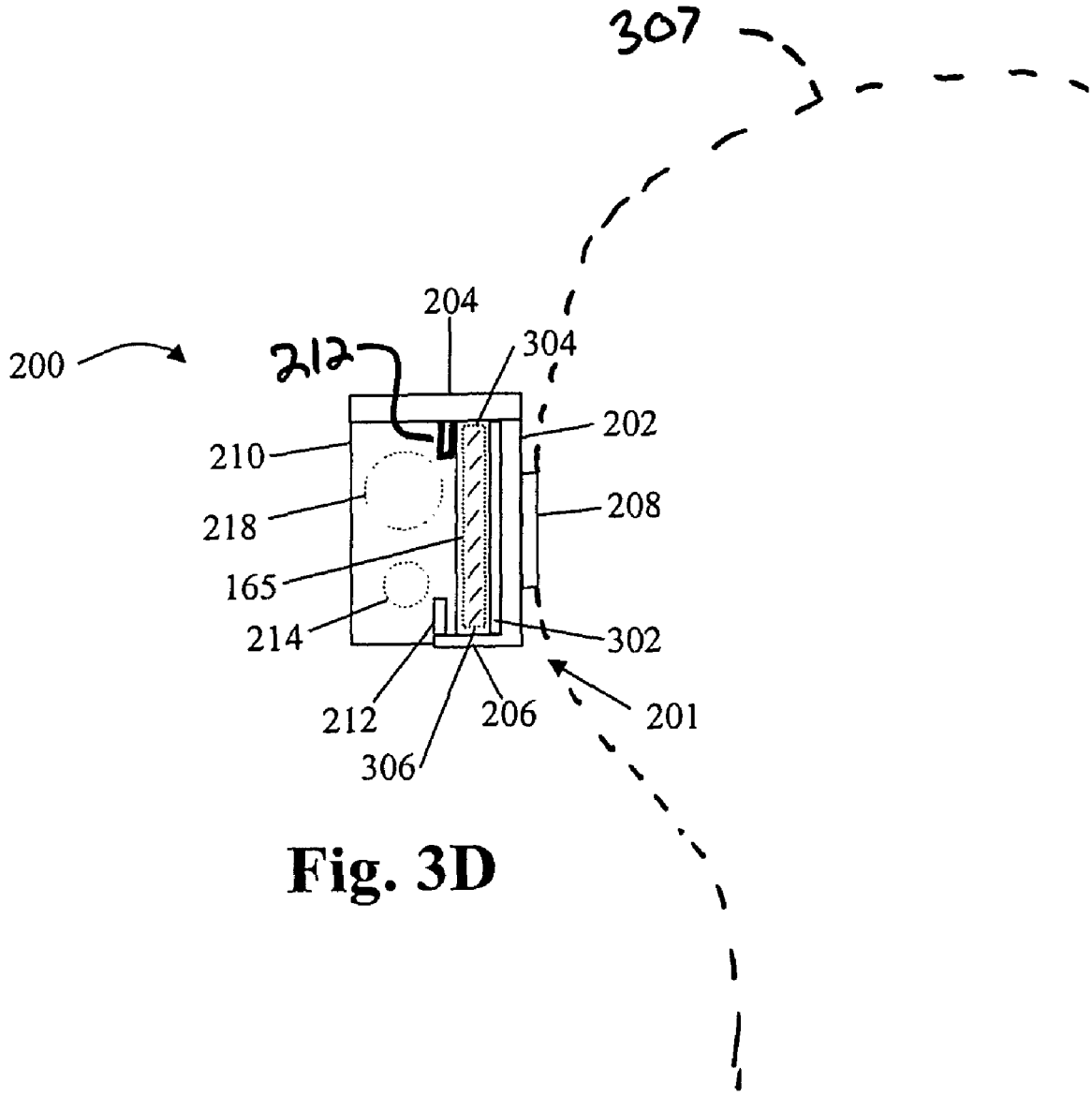
FIG. 3D is a cross sectional view of the assembly illustrated in FIG. 2.

The communications device, described herein, can be used with any helmet or hat that has a headband. Preferably the helmet or hat is a protective helmet, such as a fireman's helmet, a construction hardhat, etc. FIG. 1B illustrates a typical protective helmet 150. Preferably, the protective helmet 150 includes a shell 152, a suspension harness 154, a headband 170 having a napestrap portion 165, and a ratchet sleeve 160. The shell 152 provides protection from falling objects and is secured to the user's head by the headband 170. The headband 170, which surrounds a user's head, is connected to the shell 152 via the suspension harness 154. Generally the headband 170 is adjustable. The headband 170 has a first adjustment strap 170A and a second adjustment strap 170B. Generally, the adjustment straps 170A, 170B are located in the back of the helmet 150 and form part of the napestrap 165. The portion of the headband 170 engaging the lower rear portion of the user's head at or near the nape of the user's neck is referred to herein as the napestrap 165. The adjustment straps 170A and 170B allow the size of the headband 170 to be changed. The headband 170 may be adjusted in any known manner, such as with one or more projecting members or tabs (not shown) on adjustment strap 170A that can be inserted into a one or more holes (not shown), in a series of holes, on adjustment strap 170B, similar to the adjustment of a napestrap commonly used on baseball caps. Preferably the napestrap has a ratchet sleeve 160 (FIG. 1C), carried by the napestrap 165 and described in more detail below, for easily adjusting the size of the headband 170.

The headband 170 for use with a ratchet sleeve 160 has a first adjustment strap 170A and a second adjustment strap 170B. The adjustment straps 170A, 170B overlap inside of the ratchet sleeve 160. The ratchet sleeve 160 has an adjustment knob 162 that rotates inside the ratchet sleeve 160 and engages adjustment straps 170A and 170B. Rotating the adjustment knob 162 in one direction decreases the size of the headband 170 by pulling adjustment straps 170A and 170B into the ratchet sleeve 160. Rotating the adjustment knob 162 in the opposite direction increases the size of the headband 170 by pushing the adjustment straps 170A and 170B out of the ratchet sleeve 160.

Generally, headbands are made of relatively flexible rigid plastic material having a rectangular configuration. The rectangular configuration has a first dimension, typically between ¾" and 1", and a second dimension, typically around 1/16". The rectangular configuration allows the headband 170 to be rigid in one direction and be flexible in the other direction enabling it to roughly conform to the shape of the user's head. In addition, the ratchet sleeve 160 is made of relatively rigid plastic that is curved slightly, roughly proportional to the curve of a typical user's head. The ratchet sleeve 160, while fairly rigid, also conforms to a user's head. While the headband 170 is flexible in first direction, it is rigid in the second direction. Thus the headband provides a desirable support for mounting a bone conduction microphone having the weight of the bone conduction microphone and its support carried by the headband.

The communications device described herein can be positioned anywhere along headband 170. Preferably, the communications device is secured to the napestrap 165. Still more preferably, the communications device is secured to the ratchet sleeve 160. Thus, the use of the terms "headband", "napestrap" and/or "ratchet sleeve" throughout the description with reference to mounting the communications device does not limit the position of the assembly to any one particular position. Furthermore, all types of headbands used with protective helmets have been considered for use with the device described herein and are within the spirit and scope the present invention.

Illustrated in FIGS. 2, 3A, 3B, 3C and 3D is one embodiment of a communications device 200. Preferably, the communications device 200 includes a support member 201, a bone conduction microphone 207 a speaker assembly 108 connected to the support member 201 via a flexible boom 224, and a cable 220 for placing the communication device 200 in circuit communication with a radio transmitter/receiver (not shown). The flexible boom 224 can be made up of any flexible material, such as flexible conduit, rubber, multi-conductor wire, etc. Preferably, however, the flexible boom 224 is hollow member to facilitate the passage of the electrical conductors required for the speaker.

The support member 201 is used to releasably mount the bone conduction microphone 207 to the headband 170 of the helmet. In one embodiment, the support member 201 includes a support plate 202, an upper flange 204, a lower flange 206, a plurality of tabs 212, and an electronics housing 210. The upper support flange 204 and lower flange 206 are attached to opposite sides of the support plate 202. In an alternative embodiment, the support flanges 204, 206 are connected directly to the microphone 207 and the support plate 202 is not required. The support flanges 204 and 206 are substantially perpendicular to the support plate 202 forming a generally U-shaped channel. The U-shaped channel is curved slightly to conform to the general shape of the napestrap 165 and/or ratchet sleeve 160. The upper and lower flanges 204, 206, respectively, are configured to extend over a top edge and a bottom edge of a napestrap 165 (FIGS. 3D and 4) to facilitate securing the communications device to the napestrap 165. The upper support flange 204 is configured to rest on the top edge of the napestrap 165. Thus, the napestrap 165 supports the weight of the communications device 200 when the communications device 200 is mounted on the napestrap 165. In addition, the support member 201 positions the microphone 207 between the napestrap 165 and the user's head 307. Securing the communication device 200 to the napestrap 165 will be described in more detail below. Preferably the support plate 202 and support flanges 204, 206 are curved slightly to conform to the general shape of a napestrap 165 in a protective helmet 150. In addition, the lower flange 206 and upper flange 204 have a plurality of tabs 212A, 212B, 212C, 212D located opposite the support plate 202 so that the tabs 212 A–D extend perpendicular to the lower flange 206 and upper flange 204. When mounted on the napestrap 165, the tabs 212 A–D extend upwardly from the lower flange 206 and downwardly from the upper flange 204 in the back of the napestrap 165 and aid in the securing the support member 201 to the napestrap 165.

The upper flange 204 is configured to carry the electronic housing 210. In one embodiment, the upper flange 204 extends beyond the end of the support plate 202, in the direction of speaker 108 and carries or supports the electronics housing 210. Preferably electronics housing 210 has a face plate 214 that extends from the upper flange 204 to approximately the bottom of support plate 202. The face plate 214 is substantially parallel to the support plate 202 (see FIG. 2). It should be noted that since the support plate 202 is slightly curved, the face plate 214 is not literally parallel to the support plate 202. Preferably, the electronics housing 210 is spaced rearwardly with respect to the microphone 207 by a distance sufficient so that the napestrap 165 can be slipped between the microphone 207 and the electronics housing 210. Preferably, the electronics housing 210 is configured to receive a radio interface cable 220 and a flexible boom 224. The radio interface cable 220 has a cable connector 222 for connection to a radio transmitter/receiver (not shown) on a first end and a cable strain relief connector 218 located near the second end. The cable strain relief connector 218 is secured to the electronics housing 210.

The radio interface cable 220 is electrically coupled to PCB 120, which is located in electronics housing 210. Preferably, PCB 120 is also coupled to the speaker assembly 108 through wires (not shown) that are housed in the flexible boom 224. In one embodiment, the bone conduction microphone 207 is made up of a vibration sensing device 420 (FIG. 4) that is encased in a sensing element cavity 208, and electrical circuitry located on PCB 120. The sensing element cavity 208 provides a soft surface for contacting a user's head 307. The soft surface provides comfort during long periods of use. In addition, the sensing element cavity 208 provides a medium for conducting the vibrations traveling through the cranial bones to the vibration sensing device 420. In one embodiment, the sensing element cavity 208 is secured to the front of the support plate 202. Preferably, however, the support plate 202 has an aperture through it and the sensing element cavity 208 is inserted there through. In this embodiment, a back cover 302 (FIG. 3C) is utilized to secure the sensing element cavity 208 in place and to protect the wiring that extends out of the back of the sensing element cavity 208. Additionally, the sensing element cavity 208 can be protected by a rubber pad, wherein the rubber pad is configured to contact the user's head 307 and provide a layer of protection for the sensing element cavity 208.

In general, the U-shaped channel support member 201 and the electronic housing 210 form an aperture to receive a headband 170, napestrap 165, and/or ratchet sleeve 160 (FIG. 1B) there through. The weight of the communication device 200, the upper flange 204, and the electronic housing 210 serve to releasably mount the communication device 200 to the napestrap 165. In addition, the tabs 212 A–D located on the lower flange 206 and upper flange 204 extend upwardly and downwardly, respectively, in the back of the napestrap 165, and function to aid in releasably mounting the device to the napestrap 165. In addition, the pressure applied to the communication device 200 while in use, with the microphone 207 positioned between a user's head 307 and the napestrap 165 further acts to securely hold the communications device 200 in place. The bone conduction microphone 207 can be positioned in a plurality of locations so that during use the bone conduction microphone 207 is between the napestrap 165 and the user's head 307. Preferably, the device positions the bone conduction microphone 207 in the center of the back of the user's head 307.

The positioning of the bone conducting microphone, as used herein, includes the entire bone conduction microphone and/or a portion thereof. For example, the statement "placing the bone conduction microphone between the napestrap and the user's head" includes placing merely the vibration sensing portion of the bone conduction microphone between the napestrap and the user's head. Thus, a portion of the bone conduction microphone can be located in the electronics housing. As a result, the napestrap can be positioned between the bone conduction microphone and the electronics housing even if a portion of the bone conduction microphone is located in the electronics' housing.

Figure 4:
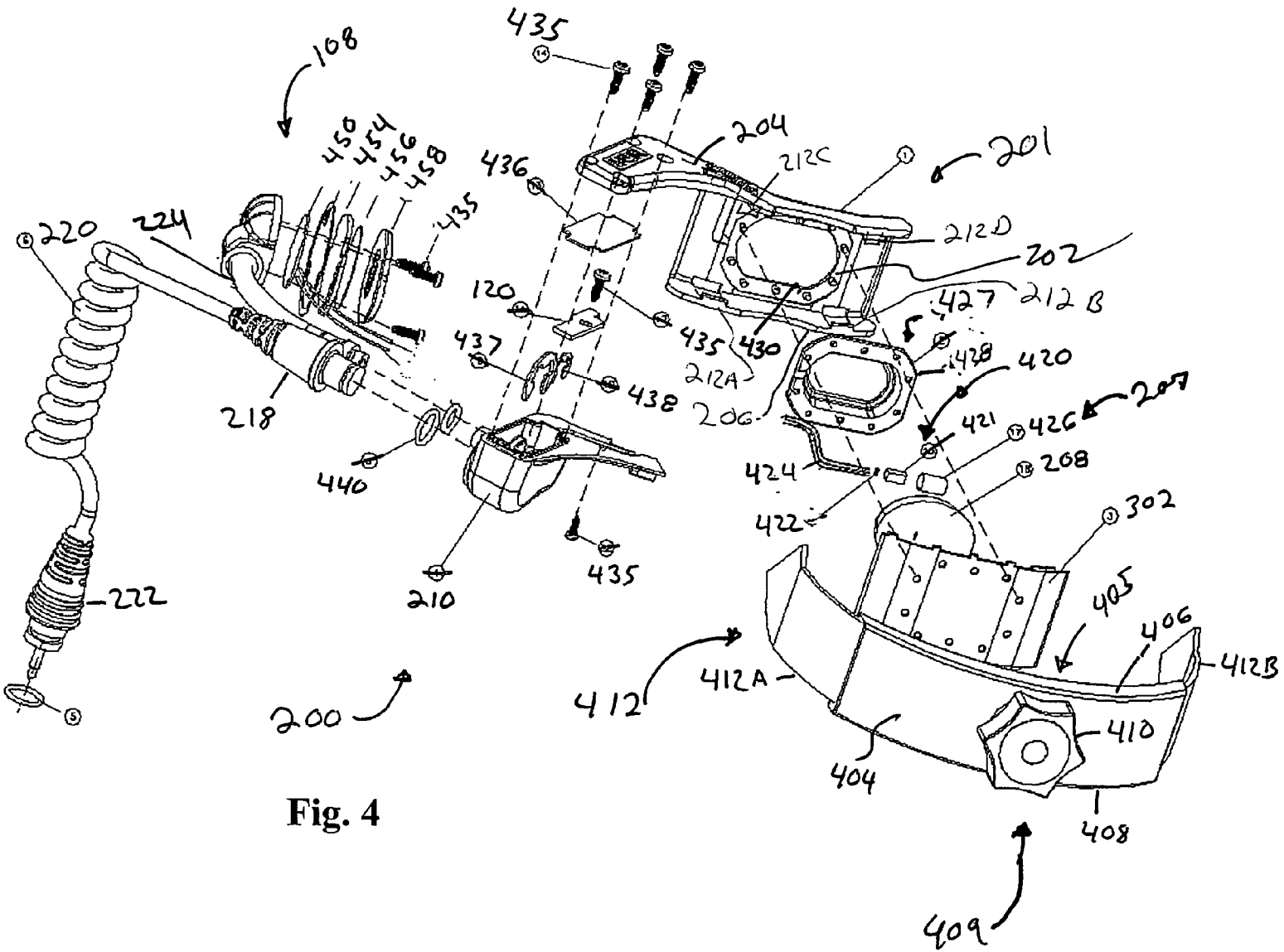
FIG. 4 is an exploded view of one embodiment of the inventive communications device with an adjustable napestrap.

FIG. 4 is a detailed illustration of an exploded view of one embodiment of the communication device 200 and an adjustable headband 412. The adjustable headband 412 includes adjustment straps 412A and 412B, a ratchet sleeve 409 having an adjustment knob 410, a back 404, a front 405, a top edge 406, and a bottom edge 408. The headband 412 is adjusted by rotating the adjustment knob 410 on the ratchet sleeve 409. Rotating the adjustment knob 410 in one direction decreases the size of headband 412 by tightening adjustment straps 412A, 412B. Rotating the adjustment knob 410 in the opposite direction increases the size of headband 412 by loosening the adjustment straps 412A, 412B. While the present embodiment is described in detail relating to an adjustable napestrap with a ratchet sleeve, all types of adjustable headbands are contemplated and within the spirit and scope of the present invention.

The communication device 200 includes a support member 201 that has an aperture 430. A portion of a rubber pad 427, configured to enclose the sensing element cavity 208, fits through the aperture 430. Preferably, the rubber pad 427 has a flange 428 to retain the rubber pad 427 and prevent the rubber pad 427 from passing completely through the aperture 430. A vibration sensing device 420, which includes an accelerometer 421 and two capacitors 422 is connected to three wires 424, and is enclosed in a shrink wrap protector 426. The vibration sensing device 420 is encased in the sensing element cavity 208. The other end of the three wires 424 (not shown) are connected to the printed circuit board (PCB) 120. The wires 424 are protected from the environment by back plate 302 and the electronics enclosure 210. The bone conduction microphone 207 is made up of the vibration sensing device 420 and electrical circuitry located on PCB 120. It should be obvious that with minor circuit changes two wires can be used to connect the vibration sensing device 420 to PCB 120.

The upper flange 204 of the support member 201 is configured to carry the electronics housing 210. The electronics housing 210 is secured to the upper flange 204 using a plurality of screws 435. Any method of securing the electronics housing member to the upper flange, such as with an adhesive, a snap-fitting, etc. is contemplated and within the spirit and scope of the invention. A gasket 436 seals the electronic enclosure 210 and protects the electronics from moisture and dirt. Printed circuit board, PCB 120 is located inside the electronics enclosure 210.

A speaker assembly 108 is attached to the distal end of flexible boom 224. The proximal end of the flexible boom 224 is attached to the electronics enclosure 210. Electronics enclosure 210 has a first aperture (not shown) configured to receive the flexible boom 224. The proximal end of the flexible boom 224 is inserted through an o-ring 440 and through the first aperture where it is secured to electronics enclosure 210 with a snap-ring 438. The o-ring 440 seals the connection between the flexible boom 224 and the electronics enclosure 210 and prevents dirt and moisture from entering the electronics enclosure 210. The speaker assembly 108 includes a speaker 450, gaskets 454, a speaker membrane 456 and a speaker cover 458, secured together by screws 435. The speaker 450 is connected to two wires 452, which are routed through the flexible boom 224 and connected to PCB 120. Electrical signals can be communicated to the speaker from PCB 120 causing the speaker membrane to vibrate and produce audible tones.

The electronics enclosure 210 has a second aperture (not shown) configured to receive strain relief connector 218. Strain relief connector 218 is connected to radio interface cable 220. An o-ring 440 is inserted over strain relief connector 218 to prevent moisture and dirt from entering the electronics enclosure 210. The strain relief connector 218 is inserted through the second aperture and secured in the electronics housing by a snap ring 437. The wires in the radio interface cable 220 are connected the printed circuit board. Radio interface cable 220 has a cable connector 222 configured to selectively connect to a hand-held radio transmitter/receiver and place the bone conduction microphone 207 and speaker 108 in circuit communication with the transmitter/receiver. The connection to the hand-held radio transmitter/receiver can be a direct connection or connected via the auxiliary microphone 130 (FIG. 1).

The communication device 200 is configured to be easily added to or removed from a protective helmet 150. In addition, the communication device 200 is reversible i.e. it is configured so that a user can secure the communication assembly 200 to the protective helmet 150 such that the speaker assembly 108 can be placed on either the right or the left side of the protective helmet 150. In one embodiment, the electronics housing is shaped and positioned to the side of the microphone in such a way that device can be mounted on the headband/napestrap and/or ratchet sleeve in two different configurations. The first configuration having the electronics housing and speaker on the user's left side, and the second configuration having the electronics housing and speaker on the user's right side. The device is adapted for mounting in the first configuration by slipping the device over the top edge of the ratchet sleeve 409 and is adapted for mounting in the other configuration by slipping the device over the bottom edge of the ratchet sleeve 409.

The speaker assembly can be positioned on the left side of the protective helmet 150 by positioning the communication device 200 over the ratchet sleeve 409 so that the microphone 207 is in front of ratchet sleeve 409 and the electronics housing 210 is in the back of ratchet sleeve 409. The communication device 200 is slipped over the top edge of the ratchet sleeve 409 and positioned so that the upper flange 204 comes to rest on the top edge 406 of ratchet sleeve 409 with the microphone 207 in front of ratchet sleeve 409 and the electronic housing 210 in back of ratchet sleeve 409. The lower flange 406 is positioned so that the lower flange 406 is directly below the bottom edge 408 of ratchet sleeve 409. Preferably tabs 212A, 212B are provided on the lower flange 206, and tabs 212C and 212D are provided on the upper flange 204. The tabs 212 A–D can be positioned behind the back 404 of ratchet sleeve 409. Thus, tabs 212 A–D can engage the back of the ratchet sleeve 409 and aid in securing the assembly 200 to the ratchet sleeve 409. In this configuration, the weight of the communication device 200 is carried by the upper flange 204.

The speaker assembly can be positioned on the right side of the protective helmet 150 by positioning the communication device 200 upside down and below ratchet sleeve 409 so that the microphone 207 is in front of ratchet sleeve 409, and the electronics housing 210 is in back of ratchet sleeve 409. The communication device 200 is slipped over the bottom edge 408 of the ratchet sleeve 409 so that the upper flange 204 comes to rest on the bottom edge 408 of ratchet sleeve 409 with the microphone 207 in front of ratchet sleeve 409 and the electronic housing 210 in back of ratchet sleeve 409. The lower flange 206 is positioned so that the lower flange 206 is directly above the top edge 406 of ratchet sleeve 409 and tabs 212A and 212B, on the lower flange 206, and tabs 212C and 212D on the upper flange 204 are behind the back 404 of the ratchet sleeve 409. The tabs 212 A–D engage the back of the ratchet sleeve 409 and aid in securing the assembly 200 to the ratchet sleeve 409. In this configuration, the weight of the communications device 200 is carried by the lower flange 206.

Bone conduction microphones must be positioned firmly against the bone through which the vibrations are traveling for the bone conduction microphone to consistently and reliably detect the vibrations and convert the detected vibrations to electrical signals. The bone microphone described herein is capable of sensing vibrations from the cranium through intermediate materials, such as human hair, hoods, mask harnesses, protective liners, etc. The positioning of the bone conduction microphone 207 directly between the headband 412 and a user's head 307 greatly enhances the reliability and consistency of the communications. Further an optimal position for detecting the vibrations created by a user's vocal cords is in the center of the back of the user's head. Positioning a bone microphone between a napestrap and the center of a user's head provides for reliable and consistent positioning of the bone microphone in an optimum position to detect the vibrations. The headband can be adjusted so that the pressure can be increased or decreased on the bone conduction microphone to firmly position it against the bone.

As noted earlier, the bone conduction microphone 207 can be located anywhere along the headband so that it is positioned between the headband and the user's head during use. Tightening the headband 412 directly increases contact pressure between the microphone and the cranial bones, which enables the vibrations to pass through the cranial bones and sensing element cavity with less loss of the vibrations. Thus, the vibrations are stronger and easier to detect by the vibration sensing device 402, which increases the reliability of the communications device. Preferably, a headband having a ratchet sleeve is used and the contact pressure on the bone conduction microphone can be adjusted with a simple twist of an adjustment knob. As a result, adjustments can be made quickly and easily even in inconvenient circumstances, such as while fighting fires, performing rescue operations.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. For example, the vibration sensing device can be integrated in a napestrap or ratchet sleeve itself, thus the napestrap or ratchet sleeve becomes the support member.

Therefore, the invention, in its broader aspects, is not limited to the specific details, the representative apparatus, and illustrative examples shown and described. Accordingly, departures may be made from such details without departing from the spirit or scope of the applicant's general inventive concept.

We claimed:

1. A communication device for use with a protective helmet having a headband, the device comprising:

a bone conductor microphone, and a support to which the microphone is mounted and which is configured for releasable mounting on the headband, wherein the support positions the microphone between an inner surface of the headband and a user's head, and in contact with a user's head, when the device is mounted on the headband, and wherein the headband is adjustable and comprises: a ratchet sleeve, wherein the support is configured to releasably mount on the ratchet sleeve and position the microphone between the ratchet sleeve and the user's head, the ratchet sleeve being configured for tightening and loosening the adjustable headband, wherein tightening the headband increases pressure on the microphone, and loosening the headband decreases pressure on the microphone, the pressure on the microphone being created by forces exerted between the headband and the user's head.

2. The device of claim 1, wherein headband comprises: a napestrap, and the support is configured to releasable mount on the napestrap and further to position the microphone between the napestrap and the user's head when the device is mounted on the napestrap.

3. The device of claim 2, wherein the support comprises an upper support flange for resting on the top edge of the napestrap so that the weight of the device is supported on the top edge of the napestrap while the napestrap simultaneously secures the microphone in direct engagement with the user's head.

4. The device of claim 3, further comprising an electronics housing carried by the upper support flange of the support.

5. The device of claim 4, wherein the electronics housing is spaced rearwardly with respect to the microphone by a distance sufficient so that the napestrap can be slipped between the microphone and the electronics housing for mounting the device on the napestrap.

6. The device of claim 5, wherein the support is configured to position the microphone at or near the center of the back of the user's head and further wherein the electronics housing is mounted to the side of the microphone.

7. The device of claim 2, wherein the support is configured so that the device can be mounted on the napestrap in its use position without adjustment of moveable parts.

8. The device of claim 7, wherein the support comprises: an upper support flange for resting on the top edge of the napestrap, and a lower support flange for positioning below the lower edge of the napestrap, the microphone, upper support flange and lower support flange together defining a U-shaped channel for receiving the napestrap.

9. The device of claim 8, wherein the support is made from a single piece of molded plastic.

10. The device of claim 8, further comprising an electronics housing carried by the upper support flange of the support.

11. The device of claim 10, wherein the support is configured to position the microphone at or near the center of the back of the user's head and further wherein the electronics housing is positioned to the side of the microphone.

12. The device of claim 11, wherein the electronics housing is spaced rearwardly with respect to the microphone by a distance sufficient so that the napestrap can be slipped between the microphone and the electronics housing for mounting the device on the napestrap.

13. The device of claim 12, wherein the electronics housing is shaped and positioned to the side of the microphone in such a way that device can be mounted on the napestrap in two different configurations, a first configuration with the electronics housing on the user's left side, and a second configuration with the electronics housing on the user's right side, the device being adapted for mounting in one of these configurations by slipping the device over the top edge of the napestrap and being adapted for mounting in the other configuration by slipping the device over the lower edge of the napestrap.

14. The device of claim 1, further comprising a speaker for positioning near the ear of the user, and a flexible boom mounting the speaker to the electronics housing.

15. The device of claim 1, wherein the support comprises: an upper support flange for resting on the top edge of the headband so that the weight of the device is supported on the top edge of the headband, wherein the headband is configured to place the microphone in direct engagement with the user's head while the device is in use.

16. The device of claim 15, wherein the support further comprises: a lower support flange, wherein the upper support flange, the microphone, and the lower support flange form a generally U-shaped channel for receiving the headband.

17. The device of claim 16 wherein the support is configured so that the device can be mounted on the headband in its use position without adjustment of moveable parts.

18. The device of claim 17 further comprising: a speaker, wherein the speaker is supported by the upper support flange, and the speaker is spaced rearwardly with respect to the microphone by a distance sufficient so that the headband can be slipped between the microphone and the speaker.

19. The device of claim 18 further comprising: a flexible boom, wherein the flexible boom connects the speaker to the upper support flange.

20. A helmet comprising:

a protective shell, an adjustable headband secured to the protective shell, and a communication device comprising:

a bone conductor microphone, and a support to which the microphone is mounted and which is configured for releasable mounting on the headband, wherein the support positions the microphone between an inner surface of the headband and a user's head, and in contact with a user's head, when the device is mounted on the headband, and wherein the headband is adjustable and comprises: a ratchet sleeve, wherein the support is configured to releasably mount on the ratchet sleeve and position the microphone between the ratchet sleeve and the user's head, the ratchet sleeve being configured for tightening and loosening the adjustable headband, wherein tightening the headband increases pressure on the microphone, and loosening the headband decreases pressure on the microphone, the pressure on the microphone being created by forces exerted between the headband and the user's head.

21. The helmet of claim 20 wherein the support member further comprises: an upper support flange configured to rest on the top edge of the headband, and a lower support flange configured to be positioned below the lower edge of the headband, wherein the upper support flange, the microphone, and the lower support flange generally form a U-shaped channel for receiving the headband.

22. The helmet of claim 21 further comprising: an electronics housing carried by the support member.

23. The helmet of claim 22 wherein the electronics housing is spaced from the microphone by a distance sufficient so that the headband can be slipped between the microphone and the electronics housing for mounting the device on the headband.

24. The helmet of claim 23 further comprising: a speaker configured to be positioned near the user's ear.

25. The helmet of claim 24 further comprising: a flexible boom for attaching the speaker to the electronics housing.

26. The helmet of claim 20 further comprising: a portable radio transmitter/receiver configured to be selectively placed in circuit communication with the bone conduction microphone.

27. The helmet of claim 20, wherein headband comprises: a napestrap, and the support is configured to releasable mount on the napestrap and further to position the microphone between the napestrap and the user's head when the device is mounted on the napestrap.

28. The helmet of claim 27, wherein the support is configured so that the device can be mounted on the napestrap in its use position without adjustment of moveable parts.

29. The helmet of claim 28, wherein the support comprises: an upper support flange for resting on the top edge of the napestrap, and a lower support flange for positioning below the lower edge of the napestrap, the microphone, upper support flange and lower support flange together defining a U-shaped channel for receiving the napestrap.

30. The helmet of claim 29, further comprising an electronics housing carried by the upper support flange of the support.

31. The helmet of claim 30, wherein the support is configured to position the microphone at or near the center of the back of the user's head and further wherein the electronics housing is positioned to the side of the microphone.

32. The helmet of claim 31, wherein the electronics housing is spaced rearwardly with respect to the microphone by a distance sufficient so that the napestrap can be slipped between the microphone and the electronics housing for mounting the device on the napestrap.

33. The helmet of claim 32, wherein the electronics housing is shaped and positioned to the side of the microphone in such a way that device can be mounted on the napestrap in two different configurations, a first configuration with the electronics housing on the user's left side, and a second configuration with the electronics housing on the user's right side, the device being adapted for mounting in one of these configurations by slipping the device over the top edge of the napestrap and being adapted for mounting in the other configuration by slipping the device over the lower edge of the napestrap.

* * * * *